United States Patent [19]

Whitehurst

[11] Patent Number: 4,775,421

[45] Date of Patent: Oct. 4, 1988

[54] METHOD OF REMOVING TEXTILE ROLL LAP-UPS

[75] Inventor: Joe R. Whitehurst, Bessemer City, N.C.

[73] Assignee: Ronald M. Heafner, Gaston, N.C.

[21] Appl. No.: 28,733

[22] Filed: Mar. 23, 1987

[51] Int. Cl.[4] ..... D01H 5/60

[52] U.S. Cl. ..... 134/6; 15/256.53; 19/262; 28/295; 57/300

[58] Field of Search ..... 19/262; 57/300, 306; 15/256.51, 256.53; 28/295; 134/6

[56] References Cited

U.S. PATENT DOCUMENTS 1,276,685 8/1918 Payment ..... 28/295 X 2,736,962 3/1956 Putman ..... 28/295 X

*Primary Examiner*—Robert R. Mackey

*Attorney, Agent, or Firm*—Bell, Seltzer, Park & Gibson

[57] ABSTRACT

Strand lap-ups may be removed from textile rolls by using the present method and apparatus while the textile rolls remain in position on the textile machine or by initially removing a roll with a lap-up thereon from the textile machine before shearing and severing the lap-up and replacing the removed roll with another roll free of any lap-ups. The present apparatus includes a wheeled hand truck with a vertical array of spaced shelves with at least one of the shelves containing replacement textile rolls and another shelf serving to receive textile rolls having lap-ups thereon. An electrically powered shear is associated with the hand truck and includes a pair of generally parallel cooperating rows of teeth facing in a common direction with the free ends of the teeth being blunt to prevent damage to the roll when being utilized to remove the lap-up from the roll. A battery and battery charger are carried by lower regions of the hand truck and the hand truck is dimensioned to easily maneuver down relatively narrow aisles between rows of adjacent textile machines in a textile mill.

8 Claims, 2 Drawing Sheets

METHOD OF REMOVING TEXTILE ROLL LAP-UPS

FIELD OF THE INVENTION

This invention relates generally to a method and apparatus for removing textile roll lap-ups, and more particularly to a portable hand truck dimensioned to easily maneuver in the narrow aisles between adjacent rows of textile machines and including an electrically powered shear, a battery for supplying power to the shear and spaced shelves for supporting replacement textile rolls free of lap-ups and textile rolls having lap-ups thereon.

BACKGROUND OF THE INVENTION

Various types of textile machines, such as spinning frames and the like, employ various types of rolls in the drafting of the fibrous textile material. When the strand becomes broken for one reason or another it is common for the fibrous material to become wound around and accumulate on the rolls, and this condition is commonly referred to as a "lap-up." It is the common practice for the textile machine attendant to remove the lap-up by using a pocket knife to cut through and separate the lap-up from the roll and then manually remove the same. In many instances, the pocket knife blade damages the roll covering so that the roll has a greater tendency to pick up fibrous material and the roll may become damaged to the point that it is no longer usable. In some cases the attendant is provided with a suitable hooked blade which is shaped on the outer end to prevent the blade from digging into the covering of the roll. However, in either of these instances, the manual removal of the lap-up is a costly and time-consuming operation.

SUMMARY OF THE INVENTION

With the foregoing in mind, it is an object of the present invention to provide a method and apparatus for removing textile roll lap-ups by the use of an electrically powered shear having a pair of rows of teeth with blunt ends facing in a common direction and with the free ends of the teeth being blunt for preventing damage to the textile roll and while applying forward pressure to force the teeth of the shear through the lap-up and sever the same from encircling relationship with the roll. The lap-up may be removed from the roll while positioned on the textile machine or the lapped roll may be removed and replaced so that the textile machine may be again operated immediately, and the lap can be removed from the lapped roll at a later time.

In accordance with the present invention, a portable unit is provided for facilitating attending to textile machines whenever a lap-up occurs. The portable unit includes a wheeled hand truck dimensioned to easily maneuver along the relatively narrow aisles between adjacent rows of textile machines in a textile mill. The hand truck includes a vertical array of spaced shelves with some shelves adapted to support replacement textile rolls free of any fibrous lap-up while other shelves are adapted to support textile rolls having lap-ups thereon. A battery and battery charger are carried by lower regions of the hand truck and an electrically powered shear is supported on upper regions of the hand truck and is electrically connected to the battery and charger. The electrically powered shear includes generally parallel rows of teeth facing in a common direction with the free ends of the teeth being blunt for preventing damage to the roll.

The portable unit is moved down the narrow aisles between adjacent textile machines by the attendant and may be positioned closely adjacent the position where the lap-up occurs so that the attendant may either quickly replace a lapped roll with a clean roll, storing the lapped roll on the hand truck and obtaining a clean roll from a storage space on the hand truck, so that the lapped rolls may be cleaned after the lapped rolls from several textile machines have been accumulated on the hand truck. Also, the portable unit may be used to remove the lap-up while the textile roll remains on the textile machine. In this case, the electrically powered shear is used to cut through the fibrous lap-up and the accumulation of fibrous material is removed while the textile roll remains in position on the textile machine.

In either event, the blunt rows of teeth on the electrically powered shear are positioned in engagement with the fibrous lap-ups so that they extend generally parallel to the roll and the shear is pivotally rocked lengthwise of the roll while forward pressure is applied to the shear to force the teeth through the lap-up and sever the same from encircling relationship with the roll. When the encircling fibrous lap-up has been severed by the shear, it may then be easily removed from the roll so as to free the roll from the fibrous lap-up.

BRIEF DESCRIPTION OF THE DRAWINGS

Other objects and advantages will appear as the description proceeds when taken in connection with the accompanying drawings, in which

FIG. 7 is an enlarged fragmentary view of a portion of FIG. 6 and illustrating the manner in which the electrically powered shear is rocked back and forth to force the teeth of the shear through the lap-up;

FIG. 8 is an enlarged fragmentary perspective view of the generally parallel cooperating rows of teeth of the shear and illustrating the blunt ends thereof;

FIG. 9 is an enlarged fragmentary view of the right-hand portion of FIG. 8 to more clearly illustrate the blunt ends on the teeth of the shear; and FIG. 10 is a somewhat schematic electrical diagram illustrating the self-contained power unit for the electrically powered shear.

DESCRIPTION OF THE ILLUSTRATED EMBODIMENTS

Figure 1:
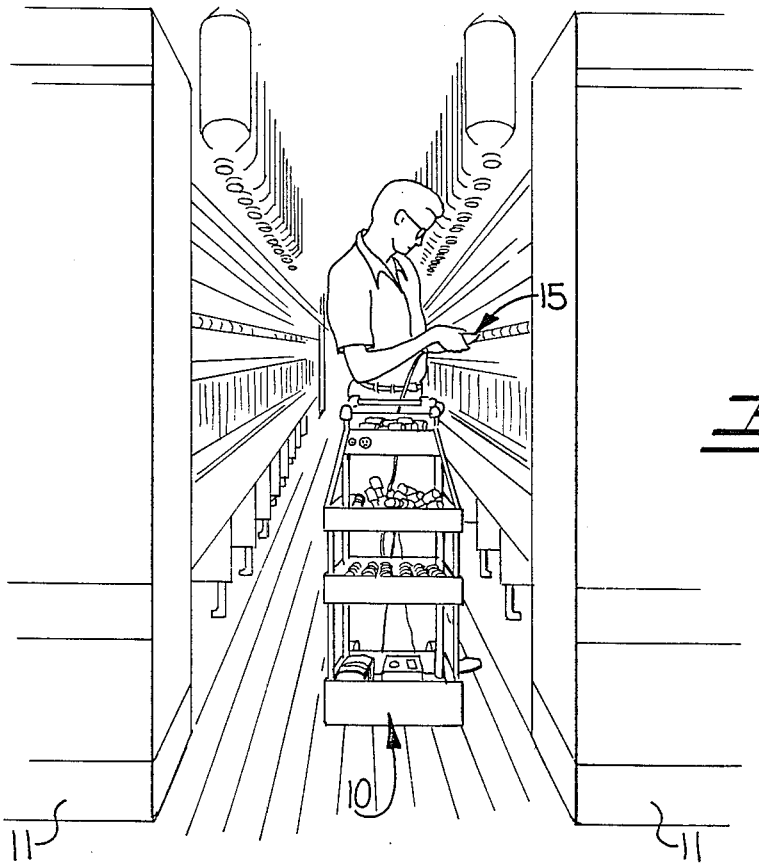
FIG. 1 is a perspective view looking down a narrow aisle between adjacent rows of textile machines and showing an attendant removing a lap-up from a textile roll with the apparatus of the present invention.

The apparatus for removing textile roll lap-ups may be operated in accordance with the method illustrated in FIG. 1 wherein the attendant is using the hand truck primarily as a portable power source for the electrically powered shear to remove the lap-ups while the textile rolls are maintained in position on the textile machine. Alternatively, the apparatus of the present invention may be utilized in accordance with the method illustrated in FIG. 4 wherein the attendant has removed and replaced the textile rolls with lap-ups and is using the hand truck and the electric shear for removing the lap-ups at a location out of the narrow aisles, illustrated as being at a location adjacent one end of the rows of textile machines.

In either mode of operation, the present invention includes a hand truck, broadly indicated at 10, which is relatively narrow, less than two feet wide, and preferably approximately sixteen inches wide, to easily maneuver into the desired position along a relatively narrow aisle extending between rows of adjacent textile machines, indicated at 11. Although the textile machines 11 are illustrated as spinning machines, it is to be understood that the present invention can be used with other types of textile machines wherein lap-ups occur on rolls, such as roving machines, pin drafters and the like. Lap-ups occur normally on the front upper drafting or delivery rolls of the spinning frame and the attendant is shown in FIG. 1 using an electrically powered shear, broadly indicated at 15, to remove the lap-up while the delivery roll 12 remains in operative position on the spinning frame 11.

Figure 2:
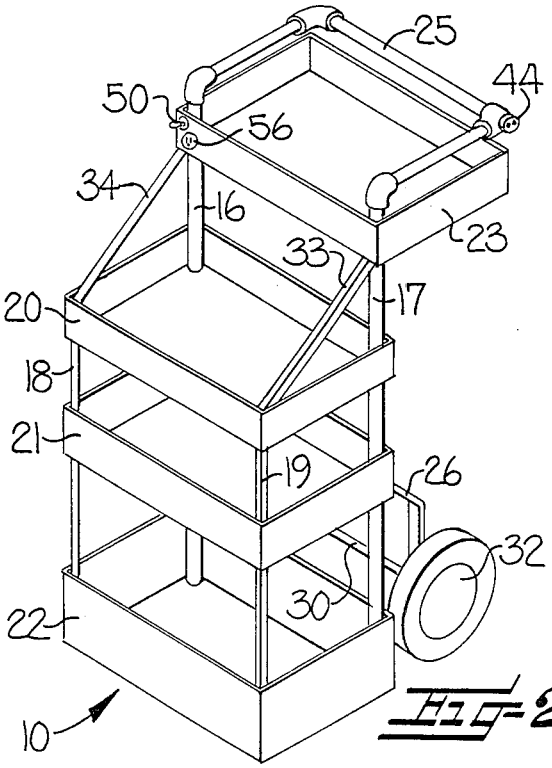
FIG. 2 is an isometric view of the front and one side of the wheeled hand truck.
Figure 3:
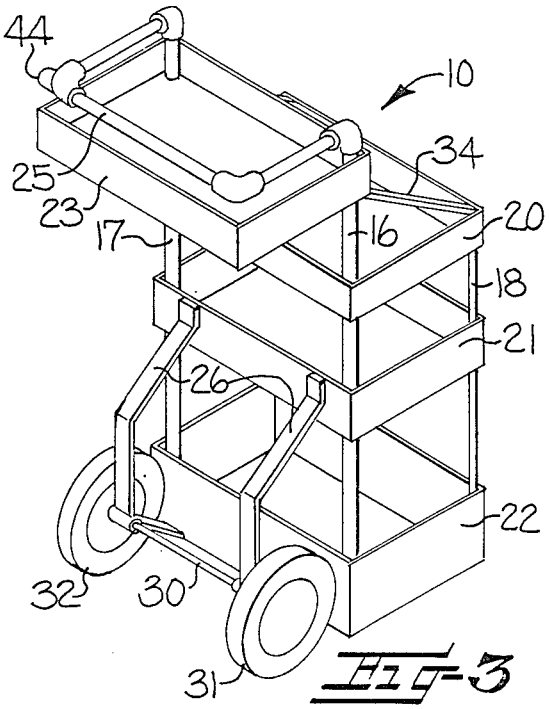
FIG. 3 is a view similar to FIG. 2 but showing the rear and the opposite side of the hand truck shown in FIG. 2.

As best illustrated in FIGS. 2 and 3, the hand truck 10 includes rear hollow vertical support frame members 16, 17 and front vertical frame members 18, 19. A vertical array of spaced shelves 20–22 is supported on the vertical frame members 16–19. The spaced shelves 20, 21 are each provided with upstanding peripheral walls to essentially form trays and provide storage areas, for purposes to be presently described. An upper and rearwardly projecting shelf 23 is supported on the upper ends of the hollow rear vertical frame members 16, 17 and also includes upstanding peripheral walls. A guiding handle 25 is provided by hollow frame members fixed to the upper ends of the vertical hollow frame members 16, 17 and extending horizontally therefrom in substantially a U-shaped configuration. Brace frame members 26 are fixed at their upper ends on the shelf member 21 and their lower ends are fixed to axle bushings for rotatably supporting an axle 30 with wheels 31, 32 fixed for rotation at opposite ends thereon. The lower portions of the wheels 31, 32 are clear of the floor when the hand truck 10 is upright, and engage the floor to permit rolling movement when the hand truck is inclined rearwardly. Diagonal brace members 33, 34 extend between and are fixed at opposite ends to the front frame members 18, 19 and the rear frame members 16, 17 to support the shelves 20–22.

Figure 4:
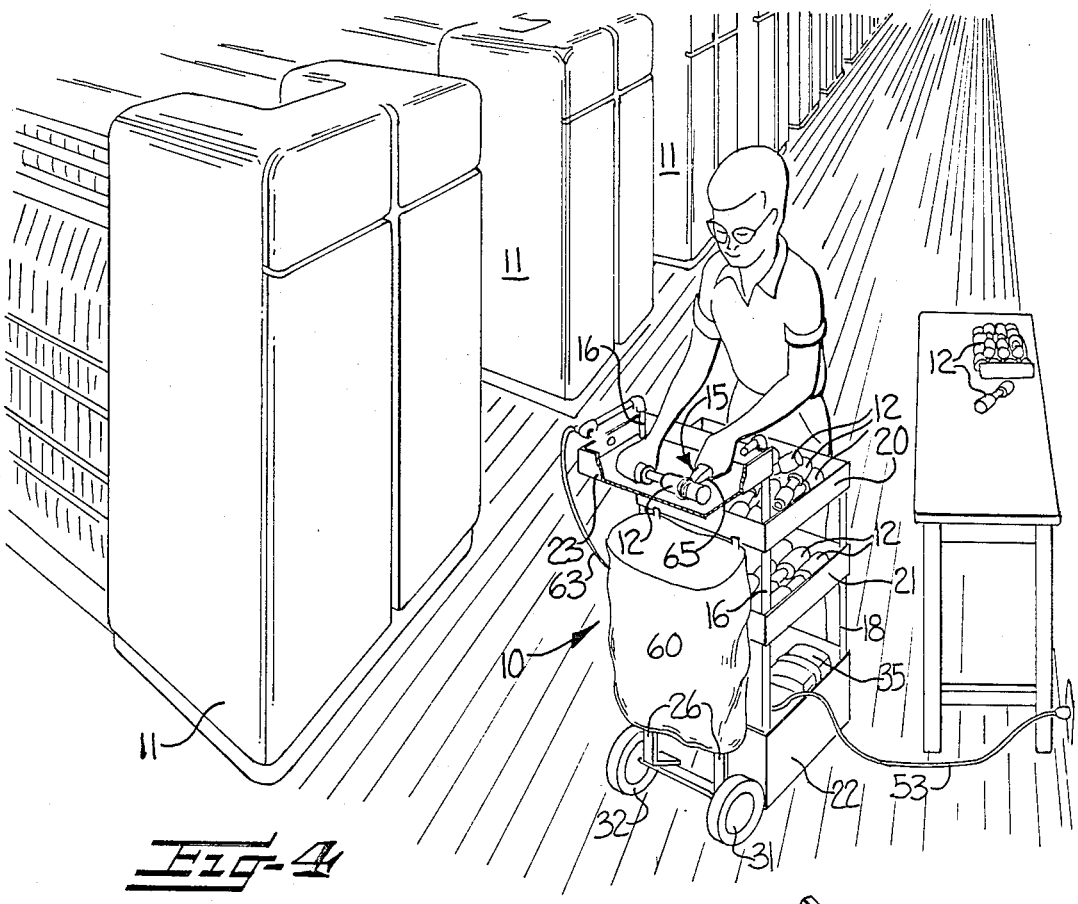
FIG. 4 is a perspective view showing the apparatus of the present invention being used adjacent one end of the rows of textile machines to remove the lap-ups from textile rolls after they have been removed from the textile machine.

The bottom shelf 22 is adapted to support a bat tery 35 (FIG. 5) and a battery charger 36 which includes a conventional maintainer circuit. As shown in FIG. 10, the battery 35 and the battery charger 36 are electrically connected together by wires 40, 41 and the battery 35 is electrically connected to a female 12-volt receptacle 44 by wires 45, 46. An on/off switch 50 is interposed in main 110-volt supply wires 51, 52 which may be connected to an inlet supply electrical cord 53, as shown in FIG. 4, connected to any suitable outlet wall socket to supply 110-volt current to the battery charger 36 and to lead wires 54, 55 connected at one end to the wires 51, 52 and at their other end to a 110-volt receptacle 56 supported on the shelf 23. The plug-in socket 56 may be used to plug in a suitable trouble light or the like.

Figure 5:
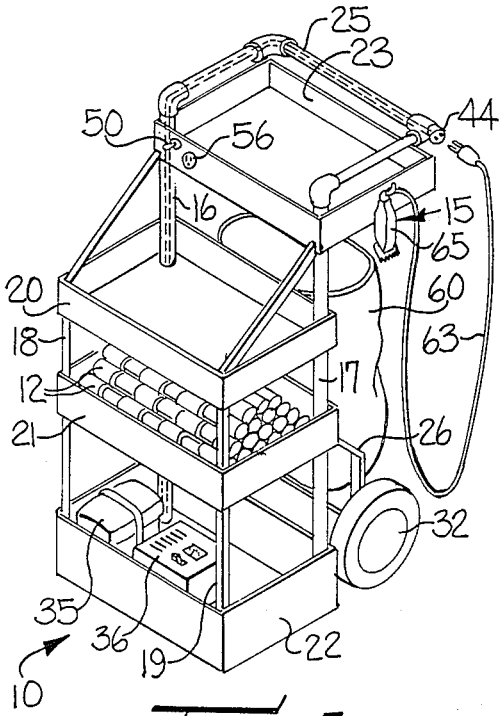
FIG. 5 is a view similar to FIG. 2 but showng the battery charger, battery, electrically powered shear, and clean textile rolls supported by the hand truck.

The rear portion of the upper shelf 20 is provided with suitable clip attachments to which a fiber deposit bag 60 may be attached (FIGS. 4 and 5). The 12-volt receptacle 44 is adapted to receive the male plug of a power supply wire 63, electrically connected to the electrically powered shear 15. The shear 15 is provided with an on/off switch 66 and respective fixed and reciprocating blades 67, 68. The fixed and reciprocating blades 67, 68 are provided with a pair of generally parallel cooperating rows of teeth *67a, 68a* on their outer ends. The teeth *67a, 68a* face in a common direction with the free ends of the teeth being blunt, as illustrated in FIG. 9, for preventing damage to the surface of the roll 12 when being utilized to sever the encircling fibrous lap-up.

Figure 6:
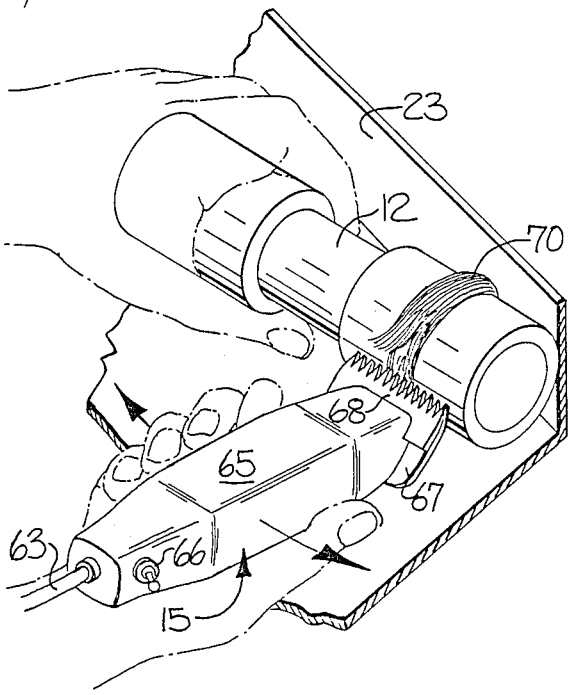
FIG. 6 is an enlarged fragmentary perspective view illustrating the manner in which the lap-up is severed from the textile roll by the electrically powered shear.

As illustrated in FIGS. 6 and 7, the fibrous lap-up, indicated at 70, is removed from the roll 12 by moving the shear 15 in a path transverse of the fibrous lap-up 70 and into engagement with the fibrous lap-up so that the outer ends of the rows of teeth *67a, 68a* extend generally parallel to the surface of the roll 12. By applying forward pressure to the shear, the teeth of the shear are forced inwardly through the fibrous lap-up 70 to sever the same. Also, as inward force is applied to the shear 15, the shear 15 is pivotally rocked generally lengthwise of the roll, as illustrated in dotted lines in FIG. 7, to force the teeth of the shear through the lap-up and sever the same from encircling the roll 12. When the fibrous lap-up 70 has been severed at one location, it can be manually unwrapped from encircling relationship with the roll 12 and may be discarded in the collection bag 60.

As has been described, the method and apparatus for removing textile roll lap-ups of the present invention may be utilized to remove the lap-ups from the rolls 12 while the rolls 12 remain in operative position on the textile machine 11 by rolling the hand truck 10 along the narrow aisle and utilizing the shear 15 in the manner described, and as shown in FIG. 1. Also, the method and apparatus for removing textile roll lap-ups in accordance with the present invention may also be utilized by providing a fresh supply of rolls 12 on one of the shelves, as shown on the shelf 21 in FIG. 5, and merely rolling the hand truck 10 along the narrow aisleways and removing any rolls 12 with lap-ups thereon and placing them in the upper shelf 12 while replacing the lap-up roll 12 with a clean roll 12 from the shelf 21. Then, the laps 70 may be removed from the rolls 12 at a position remote from the machines 11, as illustrated in FIG. 4. In this second mode of operation, the downtime of the textile machine is somewhat reduced and the lap-ups can be removed during periods of time when the attendant would otherwise be without any particular job to perform at that time.

In the drawings and specification there have been set forth the best modes presently contemplated for the practice of the present invention, and although specific terms are employed, they are used in a generic and descriptive sense only and not for purposes of limitation, the scope of the invention being defined in the claims.

That which I claim is:

1. A method of removing an encircling fibrous accumulation of a broken textile strand, commonly termed a lap-up, present on a medial portion of a roll of a textile machine, said method comprising providing an electrically powered shear having a pair of generally parallel cooperating rows of teeth facing in a common direction with the free ends of the teeth being blunt for preventing damage to the roll, severing the encircling, fibrous lap-up by moving the shear in a path transverse of the fibrous lap-up and into engagement with the fibrous lap-up so that the rows of teeth of the shear extend generally parallel to the roll and while applying forward pressure to the shear to force the teeth of the shear through the lap-up and sever the same from encircling the roll, and then removing the thus severed lap-up from around the roll so as to free the roll thereof.

2. A method according to claim 1, including initially removing the roll with the lap-up thereon from the textile machine before shearing and severing the lap-up.

3. A method according to claim 2, including replacing the removed roll with the lap-up thereon with another roll free of any lap-up prior to severing the lapup on the removed roll to facilitate reducing the period of downtime of the textile machine.

4. A method according to claims 1, 2 or 3, including pivotally rocking the shear generally lengthwise of the roll upon the lap-up as forward pressure is being applied to the shear to facilitate penetration of the teeth of the shear through the lap-up.

5. A method according to claims 1, 2 or 3, including the step of providing a wheeled hand truck having a vertical array of spaced shelves, at least one of the shelves containing replacement textile rolls free of any lap-up, another shelf serving to receive textile rolls having lap-ups thereon, a battery carried by lower regions of the hand truck and being electrically connected to the shear which is normally carried on upper portions of the hand truck and transported from one location to another by the hand truck, said method further comprising moving the wheeled hand truck along the aisles of a textile mill between rows of textile machinery to the location of the broken textile strand so that the powered shear is accessibly available for selectively (1) severing the lap-up on the textile roll without removing the lapped-up textile roll from the textile machine, (2) replacing the roll with the lap-up thereon with a roll free of any lap-up thereon and available on the hand truck for thus permitting removal of the roll with the lap-up thereon before shearing and severing the lap-up on the removed roll so as to facilitate reducing the period of downtime of the textile machine.

6. A method of removing an encircling fibrous accumulation of a broken textile strand, commonly termed a lap-up, present on a medial portion of an upper composition roll of a pair of drafting rolls on a textile machine, said method comprising providing an electrically powered shear having a pair of generally parallel cooperating rows of teeth facing in a common direction with the free ends of the teeth being blunt to avoid impaling the composition material of the upper roll for preventing damage to the roll, severing the encircling fibrous lap-up by moving the shear in a path transverse of the fibrous lap-up and into engagement with the fibrous lap-up so that the rows of teeth of the shear extend generally parallel to the roll and while pivotally rocking the shear generally lengthwise of the roll as forward pressure is being applied to the shear to force the teeth of the shear through the lap-up and sever the same from encircling the roll, and then removing the thus severed lap-up from around the roll so as to free the roll thereof.

7. A method according to claim 6, including initially removing the upper composition roll from the textile machine before shearing the lap-up thereon.

8. A method according to claim 7, including replacing the removed upper composition roll with the lap-up thereon with another composition roll free of any lap-up prior to severing the lap-up on the removed roll to facilitate reducing the period of downtime of the textile machine.

* * * * *